US010597610B2

(12) United States Patent
Ahirwal et al.

(10) Patent No.: US 10,597,610 B2
(45) Date of Patent: Mar. 24, 2020

(54) ANTIMICROBIAL HARD SURFACE CLEANER COMPRISING A THICKENING COPOLYMER

(71) Applicant: The Procter & Gamble Company, Cincinnati, OH (US)

(72) Inventors: Deepak Ahirwal, Brussels (BE); Laura Cermenati, Brussels (BE); Raphael Angeline Alfons Ceulemans, Holsbeek (BE); Joris Meert, Bambrugge (BE)

(73) Assignee: The Procter & Gamble Company, Cincinnati, OH (US)

( * ) Notice: Subject to any disclaimer, the term of this patent is extended or adjusted under 35 U.S.C. 154(b) by 79 days.

(21) Appl. No.: 15/376,699

(22) Filed: Dec. 13, 2016

(65) Prior Publication Data

US 2017/0175041 A1 Jun. 22, 2017

(30) Foreign Application Priority Data

Dec. 22, 2015 (EP) ..... 15201807
Aug. 22, 2016 (EP) ..... 16185116

(51) Int. Cl.

| | |
|---|---|
| ***C11D 3/48*** | (2006.01) |
| ***C11D 3/37*** | (2006.01) |
| ***C11D 17/00*** | (2006.01) |
| ***C11D 1/66*** | (2006.01) |
| ***C11D 1/75*** | (2006.01) |
| ***C11D 3/30*** | (2006.01) |
| ***C11D 11/00*** | (2006.01) |

(52) U.S. Cl.

CPC ..... *C11D 3/3765* (2013.01); *C11D 1/66* (2013.01); *C11D 1/75* (2013.01); *C11D 3/30* (2013.01); *C11D 3/48* (2013.01); *C11D 11/0023* (2013.01); *C11D 17/0026* (2013.01)

(58) Field of Classification Search

CPC ..... C11D 3/3765; C11D 1/66; C11D 1/75; C11D 3/30; C11D 3/48; C11D 11/0023; C11D 17/0026

See application file for complete search history.

(56) References Cited

U.S. PATENT DOCUMENTS 4,065,409 A 12/1977 Flanagan
5,948,742 A * 9/1999 Chang ..... C11D 1/662 134/198
6,180,585 B1 * 1/2001 Schalitz ..... A01N 63/00 510/195
6,270,754 B1 * 8/2001 Zhou ..... A01N 33/12 424/405
6,528,070 B1 * 3/2003 Bratescu ..... A61K 8/06 424/401
8,288,331 B2 10/2012 Hanai et al.
8,623,804 B2 1/2014 De Leersnyder et al.
8,933,010 B2 * 1/2015 Scheuing ..... A01N 25/02 510/382
2001/0049347 A1 12/2001 Robbins et al.
2002/0103098 A1 8/2002 Harrison et al.
2003/0064910 A1 * 4/2003 Fong ..... C11D 1/62 510/421
2003/0100465 A1 * 5/2003 Kilkenny ..... A01N 33/12 510/384
2003/0114342 A1 6/2003 Hall
2006/0154840 A1 * 7/2006 Yagi ..... C11D 3/0036 510/193
2006/0205619 A1 * 9/2006 Mayhall ..... A01N 33/12 510/130
2008/0293619 A1 * 11/2008 Chakrabarty ..... C07K 14/195 514/1.1
2009/0318322 A1 12/2009 Taylor et al.
2010/0160201 A1 6/2010 Scheuing et al.
2011/0230387 A1 9/2011 Leyrer et al.
2012/0213759 A1 * 8/2012 Karsten ..... C11D 1/62 424/94.1
2012/0276219 A1 * 11/2012 Taylor ..... A01N 31/16 424/638
2013/0029895 A1 1/2013 Bettiol et al.
2013/0273174 A1 * 10/2013 Scheuing ..... C09D 5/14 424/616
2014/0073546 A1 * 3/2014 Khan ..... C11D 17/0026 510/195
2015/0073051 A1 3/2015 Cohen et al.
2015/0203799 A1 * 7/2015 Bettiol ..... C11D 3/1266 510/235
2015/0264922 A1 * 9/2015 Scheuing ..... A01N 33/12 514/635
2015/0315527 A1 * 11/2015 Malaba ..... C11D 3/3726 510/418
2016/0068620 A1 * 3/2016 Tamareselvy ..... C08F 222/02 526/318.2
2016/0108340 A1 * 4/2016 Feng ..... A61Q 15/00 512/4
2016/0186095 A1 6/2016 Vockenroth et al.
2017/0175036 A1 6/2017 Cermenati et al.

FOREIGN PATENT DOCUMENTS

WO WO 99/19438 A1 4/1999
WO WO 2004/026271 4/2004
WO WO 2014/026859 A1 2/2014

OTHER PUBLICATIONS

U.S. Appl. No. 15/376,693, filed Dec. 13, 2016, Cermenati, et al.
Extended European Search Report; Application No. 15201809.9-1358; dated Jun. 13, 2016; 6 pages.
Extended European Search Report; Application No. 15201807.3-1358; dated Jun. 13, 2016; 7 pages.

* cited by examiner

*Primary Examiner* — Charles I Boyer
(74) *Attorney, Agent, or Firm* — John T. Dipre

(57) ABSTRACT

The need for a thickened liquid hard surface cleaning composition having improved transparency in addition to antimicrobial efficacy is provided by formulating the hard surface cleaning composition with an antimicrobial agent and a hydrophobic alkali swellable emulsions (HASE) comprising a thickening polymer having a certain ratio of monomers.

8 Claims, No Drawings

ANTIMICROBIAL HARD SURFACE CLEANER COMPRISING A THICKENING COPOLYMER

FIELD OF THE INVENTION

Hard surface cleaning compositions comprising an antibacterial quaternary ammonium compound and a hydrophobic alkali swellable emulsion (HASE) thickener.

BACKGROUND OF THE INVENTION

Hard surface cleaning compositions are used for cleaning and treating hard surfaces. Preferably, the hard surface cleaning composition is formulated to be an "all purpose" hard surface cleaning composition. That is, the hard surface cleaning composition is formulated to be suitable for cleaning as many different kinds of surfaces as possible.

For treating surfaces where high levels of hygiene is desired, such as kitchen toilets, bathrooms, and surfaces that small infants can come into contact with, it is desirable that the hard surface cleaning composition comprises an antibacterial agent such as a quaternary ammonium compound. In addition, a high viscosity is desired, in order to provide an impression of richness from the formulae, but also to provide greater retention on sloped surfaces. Polymeric thickeners can be used to provide an improved viscosity profile. However, polymeric thickeners, and especially those based on polyacrylate chemistry have typically been found to result in haziness in anti-bacterial compositions. It is believed that the antibacterial agent interacts with such polymeric thickeners, resulting in reduced antibacterial efficacy and haziness. Such haziness can also give users the impression that undissolved residues can remain on treated surfaces.

Therefore, a need remains for a thickened hard surface cleaning composition with improved clarity and improved disinfection, especially at short contact times.

EP1534221 A1 (Noveon) relates to a method of compatibilizing an anionic polymeric rheology modifier with cationic ingredients, which comprises complexing a cationic ingredient with an anionic complexing agent before combining the complexed cationic ingredient with an anionic rheology modifier. EP1534221 A1 further relates to a composition comprising an anionic polymeric rheology modifier and a complexed cationic ingredient and a personal care or a household composition containing an anionic rheology modifier and a cationic ingredient complexed with an anionic complexing agent.

WO2014070201 A1 (Clorox) discloses cationic micelles with anionic polymeric counterions compositions, methods and systems thereof.

WO 2014/026859 (Henkel) relates to a liquid textile or hard surface treatment agent comprising: at least one nonionic, amphiphilic associative thickener and a cationic biocidal compound.

SUMMARY OF THE INVENTION

The present invention relates to a hard surface cleaning composition comprising: a cationic antimicrobial agent; a hydrophobic alkali swellable emulsions (HASE) comprising a thickening polymer, the thickening polymer comprising: greater than 10 mol % of a carboxylic acid containing monomer; less than 90 mol % of alkyl (meth)acrylate monomer, wherein the level of C4-C8 alkyl (meth)acrylate monomer is less than 45 mol % of the thickening polymer; from 0 to 3 mol % of an associative monomer according to formula (I) or formula (II):

$$R_1—CH=CH—COO—(CH_2CH_2O)_n—R_2 \quad \text{formula (I)}$$

$$R_1—CH=CH—R_3—NH—COO—(CH_2CH_2O)_n—R_2 \quad \text{formula (II)}$$

in which: $R_1$ is H, C or COOH; $R_2$ is a C8-C30 alkyl chain, preferably aliphatic, preferably saturated, preferably linear; n is an integer between 2 and 150; and $R_3$ is a C1-12 alkyl chain.

The present invention further relates to a method of cleaning hard surfaces, the method comprising the steps of: diluting such liquid hard surface cleaning compositions, and applying the diluted composition to a hard surface.

The present invention further relates to the use of such hydrophobic alkali swellable emulsions for providing a thickened, transparent, antibacterial hard surface cleaning composition.

DETAILED DESCRIPTION OF THE INVENTION

Hard surface cleaning compositions of the present invention, comprising an antimicrobial agent, a hydrophobic alkali swellable emulsions (HASE) comprising a thickening polymer as described herein, provide a combination of improved clarity in addition to fast antimicrobial action.

As defined herein, "essentially free of" a component means that no amount of that component is deliberately incorporated into the respective premix, or composition. Preferably, "essentially free of" a component means that no amount of that component is present in the respective premix, or composition.

As defined herein, "stable" means that no visible phase separation is observed for a premix kept at 25° C. for a period of at least two weeks, or at least four weeks, or greater than a month or greater than four months.

All percentages, ratios and proportions used herein are by weight percent of the composition, unless otherwise specified. All average values are calculated "by weight" of the composition, unless otherwise expressly indicated. All ratios are calculated as a weight/weight level, unless otherwise specified.

All measurements are performed at 25° C. unless otherwise specified.

Unless otherwise noted, all component or composition levels are in reference to the active portion of that component or composition, and are exclusive of impurities, for example, residual solvents or by-products, which may be present in commercially available sources of such components or compositions.

Liquid Hard Surface Cleaning Compositions:

By "liquid hard surface cleaning composition", it is meant herein a liquid composition for cleaning hard surfaces found in households, especially domestic households. Surfaces to be cleaned include kitchens and bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, steel, kitchen work surfaces, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

In a preferred embodiment, the liquid compositions herein are aqueous compositions, comprising at least 10% by weight of water. Therefore, they may comprise from 30% to 99.5% by weight of the total composition of water, preferably from 50% to 98% and more preferably from 80% to 97%.

The compositions of the present invention preferably have a viscosity of from 50 Pa·s to 1200 Pa·s, more preferably 100 Pa·s to 800 Pa·s, most preferably 200 Pa·s to 600 Pa·s when measured at 20° C. with a AD1000 Advanced Rheometer from Atlas® shear rate 10 $s^{-1}$ with a coned spindle of 40 mm with a cone angle 2° and a truncation of ±60 μm.

For improved cleaning, especially greasy soil and particulate greasy soil cleaning performance, the composition pH is preferably greater than 7.0, more preferably greater than 9.5. For improved antibacterial efficacy, in addition to improved cleaning, the pH is still more preferably greater than 10, most preferably greater than 11. For improved surface safety, the pH is preferably less than 13, more preferably less than 12, most preferably less than 11.5. Accordingly, the compositions herein may further comprise an acid or base to adjust pH as appropriate.

A suitable acid for use herein is an organic and/or an inorganic acid. A preferred organic acid for use herein has a pKa of less than 6. A suitable organic acid is selected from the group consisting of: citric acid, lactic acid, glycolic acid, succinic acid, glutaric acid and adipic acid and mixtures thereof. A suitable inorganic acid can be selected from the group consisting of: hydrochloric acid, sulphuric acid, phosphoric acid and mixtures thereof.

A typical level of such acids, when present, is from 0.01% to 5.0% by weight of the total composition, preferably from 0.04% to 3.0% and more preferably from 0.05% to 1.5%.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, $K_2CO_3$, $Na_2CO_3$ and alkanolamines (such as monoethanolamine, triethanolamine, aminomethylpropanol, and mixtures thereof).

Typical levels of such bases, when present, are from 0.01% to 5.0% by weight of the total composition, preferably from 0.05% to 3.0% and more preferably from 0.1% to 2.0%.

The total amount of surfactant is preferably from 2 to 20, more preferably from 3 to 15 and most preferably from 5 to 12% by weight of the composition.

The present hard surface cleaning compositions have improved transparency, and thus reduced haziness. Preferably, the hard surface cleaning compositions have a % haze of from 0 to 15, more preferably 0 to 7, most preferably 0 to 5.

Antimicrobial Agent:

Suitable antimicrobial agents include cationic antimicrobial agents, such as quaternary ammonium compounds. Preferred quaternary ammonium compounds are those of the formula:

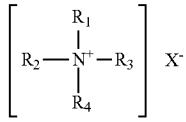

wherein at least one of $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of at least 165. The hydrophobic radicals may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical, and preferably aids in the solubilization of the quaternary ammonium germicide in water. X can be a halide, for example a chloride, bromide or iodide, or X can be a methosulfate counterion, or X can be a carbonate ion.

More preferred quaternary ammonium compounds used in the compositions of the invention include those of the structural formula:

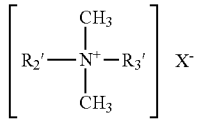

wherein $R_2'$ and $R_3'$ may be the same or different and are selected from C8-C12 alkyl, preferably $R_2'$ and $R_3'$ are C10, or $R_2'$ is alkyl, preferably C12-C18 alkyl, C8-C18 alkylethoxy, C8-C18 alkylphenolethoxy and $R_3'$ is benzyl or substituted benzyl, preferably ethyl benzyl. X is a halide, for example a chloride, bromide or iodide, or X is a methosulfate counterion. The alkyl groups recited in $R_2'$ and $R_3'$ may be linear or branched, but are preferably substantially linear, or fully linear.

Exemplary quaternary ammonium compounds include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium compounds include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Particularly useful quaternary germicides include compositions presently commercially available under the tradenames BARDAC, BARQUAT, BTC, and HYAMINE. These quaternary ammonium compounds are usually provided in a solvent, such as a C2 to C6 alcohol (such as ethanol, n-propanol, isopropanol, n-butanol, sec-butanol, and the like), glycols such as ethylene glycol, or in an mixtures containing water, such alcohols, and such glycols. Particularly preferred is didecyl dimethyl ammonium chloride, such as supplied by Lonza under tradenames such as: Bardac 2250™, Bardac 2270™, Bardac 2270E™, Bardac 2280™, and/or a blend of alkyl, preferably C12-C18, dimethyl benzyl ammonium chloride and alkyl, preferably C12-C18, dimethyl ethylbenzyl ammonium chloride, such as supplied by Lonza under the brand names: Barquat 4280Z™. In preferred embodiments, the alkyl dimethyl benzyl ammonium chloride and alkyl dimethyl ethylbenzyl ammonium chloride are present in a ratio of from 20:80 to 80:20, or 40:60 to 60:40, with a ratio of 50:50 being the most preferred.

Other suitable, but less preferred, antimicrobial agents include germicidal amines, particularly germicidal triamines such as LONZA-BAC 12, (ex. Lonza, Inc., Fairlawn, N.J. and/or from Stepan Co., Northfield Ill., as well as other sources).

In the cleaning compositions according to the invention, the antimicrobial agent, preferably quaternary ammonium compound, is required to be present in amounts which are effective in exhibiting satisfactory germicidal activity—against selected bacteria sought to be treated by the cleaning compositions. Such efficacy may be achieved against less resistant bacterial strains with only minor amounts of the quaternary ammonium compounds being present, while more resistant strains of bacteria require greater amounts of the quaternary ammonium compounds in order to destroy these more resistant strains.

The quaternary ammonium compound need only be present in germicidally effective amounts, which can be as little as 0.001 wt %. In more preferred compositions, the hard surface cleaning composition comprises the antimicrobial agent at a level of from 0.05 wt % to 5.00 wt %, preferably from 0.1 wt % to 3.0 wt %, more preferably from 0.9% to 1.5 by weight of the composition, for improved shine in addition to germicidal efficacy.

A germicidally effective amount of the antimicrobial agent is considered to result in at least a log 4.5, preferably at least a log 5 reduction of *staphylococcus aureus*, using the method of EN1276 (Chemical Disinfectants Bactericidal Activity Testing), in less than 3 minutes.

Hydrophobic Alkali Swellable Emulsion (HASE) Thickener:

The liquid hard surface cleaning composition preferably comprises from 0.1% to 10.0% by weight of the total composition of said thickener, preferably from 0.2% to 5.0%, more preferably from 0.2% to 2.5% and most preferably from 0.2% to 2.0%.

An increased viscosity, especially low shear viscosity, provides longer contact time, especially on inclined surfaces, and therefore improved penetration of greasy soil and/or particulated greasy soil. Increased viscosity improves cleaning, especially when applied neat to the surface to be treated. Moreover, a high low shear viscosity improves the phase stability of the liquid cleaning composition, and especially improves the stability of the copolymer in compositions in the liquid hard surface cleaning composition. Hence, preferably, the liquid hard surface cleaning composition, comprising a thickener, has a viscosity of from 50 Pa·s to 1200 Pa·s, more preferably 100 Pa·s to 800 Pa·s, most preferably 200 Pa·s to 600 Pa·s, at 20° C. when measured with a AD1000 Advanced Rheometer from Atlas® shear rate 10 $s^{-1}$ with a coned spindle of 40 mm with a cone angle 2° and a truncation of ±60 μm.

The hydrophobically modified alkali swellable emulsion (HASE) comprises a thickening polymer, the thickening polymer comprising the following monomers:

(a) greater than 10 mol % of a carboxylic acid containing monomer;

(b) less than 90 mol % of alkyl (meth)acrylate monomer, wherein the level of C4-C8 alkyl (meth)acrylate monomer is less than 45 mol % of the thickening polymer;

(c) 0 to 3 mol %, preferably 0.1 to 2 mol %, more preferably 0.5 to 2 mol % of an associative monomer according to formula (I) or formula (II):

$$R_1—CH=CH—COO—(CH_2CH_2O)_n—R_2 \quad \text{formula (I)}$$

$$R_1—CH=CH—R_3—NH—COO—(CH_2CH_2O)_n—R_2 \quad \text{formula (II)}$$

in which:

(i) $R_1$ is H, C or COOH;

(ii) $R_2$ is a C8-C30 alkyl chain, preferably aliphatic, preferably saturated, preferably linear;

(iii) n is an integer between 2 and 150; and (iv) $R_3$ is a C1-12 alkyl chain, which can be linear, branched, aromatic or combinations thereof;

For improved transparency, the carboxylic acid containing monomer is preferably present at a level greater than 15 mol %, more preferably 25 mol %, even more preferably greater than 35 mol % of the thickening polymer. The carboxylic acid containing monomer can be selected from the group consisting of: acrylic acid, methacrylic acid, itaconic acid or maleic acid, and mixtures thereof. For improved thickening, the carboxylic acid containing monomer is preferably present at the level of less than 90 mol %, more preferably less than 70% mol %.

As such, the alkyl (meth)acrylate monomer is preferably present at a level of less than 85 mol %, more preferably less than 75 mol %, most preferably less than 65 mol % of the thickening polymer.

For improved antibacterial efficacy, the level of C4-C8 alkyl (meth)acrylate monomer is less than 45 mol % of the thickening polymer, preferably less than 35 mol %, more preferably less than 25 mol % of the thickening polymer. Preferably, the alkyl (meth)acrylate monomer comprises C1-C3 alkyl (meth)acrylate monomer at a level of greater than 35 mol % of the thickening polymer.

n is an integer between 2 and 150. Preferably n is between 2 and 50, more preferably between 8 and 30, most preferably between 10 and 26.

The monomers of the thickening polymer sum up to 100 mol %.

The thickening polymer is preferably not crosslinked. The monomers can be randomly distributed or distributed in blocks, though random is preferred for improved thickening.

The thickening polymer comprises from 0 to 3 mol %, that is, less than 3 mol % of an associative monomer according to formula (I) or formula (II). Preferably the thickening polymer comprises 0.01 to 3 mol %, more preferably from 0.1 to 2 mol %, most preferably 0.5 mol % to 2 mol % of an associative monomer according to formula (I) or formula (II).

The thickening polymer preferably has a weight average molecular weight of from 50,000 Da to 2,000,000 Da, more preferably from 100,000 Da to 1,000,000 Da, most preferably from 300,000 Da to 600,000 Da.

Suitable hydrophobically modified alkali swellable emulsions (HASE) are sold under the various brand names by Lubrizol Corporation, Clariant, Akzo Nobel, Coatex, 3V Sigma, SEPPIC, Ashland and BASF. Particularly suited, are Novethix L10 and Novethix HC200 (Lubrizol), Crystasense Sapphire (Clariant), Alcoguard 5800 (Akzo Nobel), Rheosolve 637 and Rheosolve 650 (Coatex), Polygel W30 (3V Sigma), Capigel98 (SEPPIC), Jaypol AT4 (Ashland), Rheovis AT120, Salcare SC80 and Luvigel FIT (BASF)."

Nonionic Surfactant

The liquid hard surface cleaning composition preferably comprises a nonionic surfactant. The nonionic surfactant can be selected from the group consisting of: alkoxylated nonionic surfactants, alkyl polyglycosides, amine oxides, and mixture thereof. Typically, the liquid hard surface cleaning composition may comprise from 1.0 wt % to 10.0 wt % by weight of the total composition of said nonionic surfactant, preferably from 3.0 wt % to 9.5 wt %, more preferably from 4.0 wt % to 9.0 wt % and most preferably from 5.0 wt % to 8.0 wt %.

For dilute compositions, comprising a total amount of surfactant of from 2 to 10 wt %, preferably from 2 to 5 wt %, the nonionic surfactant is preferably present at a level of from 1.0 wt % to 5.0 wt %, more preferably from 2.0 wt % to 4.0 wt %, most preferably from 2.2 wt % to 3.5 wt % of the liquid hard surface cleaning composition.

The hard surface cleaning composition can comprise from 1 wt % to 10 wt %, preferably from 1.5 wt % to 8 wt %, more preferably from 2 wt % to 7 wt % and most preferably from 2 wt % to 6 wt % of the composition of alkoxylated alcohol, preferably ethoxylated alcohol.

Suitable alkoxylated nonionic surfactants include primary $C_6$-$C_{16}$ alcohol polyglycol ether i.e. ethoxylated alcohols having 6 to 16 carbon atoms in the alkyl moiety and 4 to 30 ethylene oxide (EO) units. When referred to for example $C_{9-14}$ it is meant average carbons and alternative reference to for example EO8 is meant average ethylene oxide units.

Suitable alkoxylated nonionic surfactants are according to the formula RO-$(A)_n$H, wherein: R is a $C_6$ to $C_{18}$, preferably a $C_8$ to $C_{16}$, more preferably a $C_8$ to $C_{12}$ alkyl chain, or a $C_6$ to $C_{28}$ alkyl benzene chain; A is an ethoxy or propoxy or butoxy unit, and wherein n is from 1 to 30, preferably from 1 to 15 and, more preferably from 4 to 12 even more preferably from 5 to 10. Preferred R chains for use herein are the $C_8$ to $C_{22}$ alkyl chains. Even more preferred R chains for use herein are the $C_9$ to $C_{12}$ alkyl chains. R can be linear or branched alkyl chain.

Suitable ethoxylated nonionic surfactants for use herein are Dobanol® 91-2.5 (HLB=8.1; R is a mixture of $C_9$ and $C_{11}$ alkyl chains, n is 2.5), Dobanol® 91-10 (HLB=14.2; R is a mixture of $C_9$ to $C_{11}$ alkyl chains, n is 10), Dobanol® 91-12 (HLB=14.5; R is a mixture of $C_9$ to $C_{11}$ alkyl chains, n is 12), Greenbentine DE80 (HLB=13.8, 98 wt % C10 linear alkyl chain, n is 8), Marlipal 10-8 (HLB=13.8, R is a C10 linear alkyl chain, n is 8), Lialethl® 11-5 (R is a $C_{11}$ alkyl chain, n is 5), Isalchem® 11-5 (R is a mixture of linear and branched C11 alkyl chain, n is 5), Lialethl® 11-21 (R is a mixture of linear and branched $C_{11}$ alkyl chain, n is 21), Isalchem® 11-21 (R is a $C_{11}$ branched alkyl chain, n is 21), Empilan® KBE21 (R is a mixture of $C_{12}$ and $C_{14}$ alkyl chains, n is 21) or mixtures thereof. Preferred herein are Dobanol® 91-5, Neodol® 11-5, Lialethl® 11-21 Lialethl® 11-5 Isalchem® 11-5 Isalchem® 11-21 Dobanol® 91-8, or Dobanol® 91-10, or Dobanol® 91-12, or mixtures thereof. These Dobanol®/Neodol® surfactants are commercially available from SHELL. These Lutensol® surfactants are commercially available from BASF and these Tergitol® surfactants are commercially available from Dow Chemicals.

Suitable chemical processes for preparing the alkoxylated nonionic surfactants for use herein include condensation of corresponding alcohols with alkylene oxide, in the desired proportions. Such processes are well known to the person skilled in the art and have been extensively described in the art, including the OXO process and various derivatives thereof. Suitable alkoxylated fatty alcohol nonionic surfactants, produced using the OXO process, have been marketed under the tradename NEODOL® by the Shell Chemical Company. Alternatively, suitable alkoxylated nonionic surfactants can be prepared by other processes such as the Ziegler process, in addition to derivatives of the OXO or Ziegler processes.

Preferably, said alkoxylated nonionic surfactant is selected from the group consisting of alkoxylated nonionic surfactants and mixtures thereof. More preferably, said alkoxylated nonionic surfactant is a $C_{9-11}$ EO5 alkylethoxylate, $C_{12-14}$ EO5 alkylethoxylate, a $C_{11}$ EO5 alkylethoxylate, $C_{12-14}$ EO21 alkylethoxylate, $C_{9-11}$ EO8 alkylethoxylate, or a mixture thereof. Most preferably, said alkoxylated nonionic surfactant is a C11 EO5 alkylethoxylate, a $C_{9-11}$ EO8 alkylethoxylate, a C10 EO8 alkylethoxylate, and mixtures thereof. Suitable $C_{10}$ EO8 alkylethoxylate include Marlipal® 10/8 supplied by Sasol, and Greenbentin® DE/080.

Alkyl polyglycosides are biodegradable nonionic surfactants which are well known in the art, and can also be used in the compositions of the present invention. Suitable alkyl polyglycosides can have the general formula $C_nH_{2n+1}O(C_6H_{10}O_5)_xH$ wherein n is preferably from 9 to 16, more preferably 11 to 14, and x is preferably from 1 to 2, more preferably 1.3 to 1.6.

Suitable amine oxide surfactants include: $R_1R_2R_3NO$ wherein each of $R_1$, $R_2$ and $R_3$ is independently a saturated or unsaturated, substituted or unsubstituted, linear or branched hydrocarbon chain having from 10 to 30 carbon atoms. Preferred amine oxide surfactants are amine oxides having the following formula: $R_1R_2R_3NO$ wherein $R_1$ is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups. $R_1$ may be a saturated or unsaturated, substituted or unsubstituted linear or branched hydrocarbon chain. Preferably, the liquid hard surface cleaning composition comprises from 0.05 wt % to 6 wt %, preferably from 0.1 wt % to 5 wt %, more preferably from 0.1 wt % to 4.5 wt % and most preferably from 0.1 wt % to 4 wt % of the composition of amine oxide surfactant.

A highly preferred amine oxide is $C_{12}$-$C_{14}$ dimethyl amine oxide, commercially available from Albright & Wilson, $C_{12}$-$C_{14}$ amine oxides commercially available under the trade name Genaminox® LA from Clariant or AROMOX® DMC from AKZO Nobel.

The nonionic surfactant is preferably a low molecular weight nonionic surfactant, having a molecular weight of less than 950 g/mol, more preferably less than 500 g/mol.

Anionic Surfactant:

The liquid hard surface cleaning composition can comprise low levels of an anionic surfactant. The anionic surfactant can be selected from the group consisting of: an alkyl sulphate, an alkyl alkoxylated sulphate, a sulphonic acid or sulphonate surfactant, and mixtures thereof. The liquid hard surface cleaning composition can comprise up to 2.0 wt %, preferably up to 1.0 wt %, or up to 0.1 wt % of anionic surfactant. In most preferred embodiments, the composition is essentially free, or free of, of anionic surfactant.

If anionic surfactant is used, alkyl ethoxylated sulphates, especially those with an ethoxylation degree of 1 to 8, preferably 2 to 5, are preferred.

Suitable alkyl sulphates for use herein include water-soluble salts or acids of the formula $ROSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Particularly suitable linear alkyl sulphates include $C_{12-14}$ alkyl sulphate like EMPICOL® 0298/, EMPICOL® 0298/F or EMPICOL® XLB commercially available from Huntsman. By "linear alkyl sulphate" it is meant herein a non-substituted alkyl sulphate wherein the linear alkyl chain comprises from 6 to 16 carbon atoms, preferably from 8 to 14 carbon atoms, and more preferably from 10 to 14 carbon atoms, and wherein this alkyl chain is sulphated at one terminus.

Suitable sulphonated anionic surfactants for use herein are all those commonly known by those skilled in the art. Preferably, the sulphonated anionic surfactants for use herein are selected from the group consisting of: alkyl sulphonates; alkyl aryl sulphonates; naphthalene sulphonates; alkyl alkoxylated sulphonates; and $C_6$-$C_{16}$ alkyl alkoxylated linear or branched diphenyl oxide disulphonates; and mixtures thereof.

Suitable alkyl sulphonates for use herein include water-soluble salts or acids of the formula $RSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{18}$ linear or branched saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Particularly suitable linear alkyl sulphonates include $C_{12}$-$C_{16}$ paraffin sulphonate like Hostapur® SAS commercially available from Clariant. Particularly preferred alkyl aryl sulphonates are alkyl benzene sulphonates commercially available under trade name Nansa® available from Huntsman.

By "linear alkyl sulphonate" it is meant herein a non-substituted alkyl sulphonate wherein the alkyl chain comprises from 6 to 18 carbon atoms, preferably from 8 to 16 carbon atoms, and more preferably from 10 to 16 carbon atoms, and wherein this alkyl chain is sulphonated at one terminus.

Suitable alkoxylated sulphonate surfactants for use herein are according to the formula $R(A)_mSO_3M$, wherein R is an unsubstituted $C_6$-$C_{18}$ alkyl, hydroxyalkyl or alkyl aryl group, having a linear or branched $C_6$-$C_{18}$ alkyl component, preferably a $C_8$-$C_{16}$ alkyl or hydroxyalkyl, more preferably $C_{12}$-$C_{16}$ alkyl or hydroxyalkyl, and A is an ethoxy or propoxy or butoxy unit, and m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like.

Exemplary surfactants are $C_{12}$-$C_{18}$ alkyl polyethoxylate (1.0) sulphonate ($C_{12}$-$C_{18}$E(1.0)SM), $C_{12}$-$C_{18}$ alkyl polyethoxylate (2.25) sulphonate ($C_{12}$-$C_{18}$E(2.25)SM), $C_{12}$-$C_{18}$ alkyl polyethoxylate (3.0) sulphonate ($C_{12}$-$C_{18}$E(3.0)SM), and $C_{12}$-$C_{18}$ alkyl polyethoxylate (4.0) sulphonate ($C_2$-$C_{18}$E(4.0)SM), wherein M is conveniently selected from sodium and potassium. Particularly suitable alkoxylated sulphonates include alkyl aryl polyether sulphonates like Triton X-200® commercially available from Dow Chemical.

Preferably said sulphated or sulphonated anionic surfactant for use herein is selected from the group consisting of alkyl sulphates (AS) preferably $C_{12}$, $C_{13}$, $C_{14}$ and $C_{15}$ AS, sodium linear alkyl sulphonate (NaLAS), sodium paraffin sulphonate $NaPC_{12-16}S$, and mixtures thereof. Most preferably sulphated or sulphonated anionic surfactant for use herein is selected from the group consisting of alkyl sulphates (AS) preferably, $C_{12}$, $C_{13}$, $C_{14}$ and $C_{15}$ AS, sodium linear alkyl sulphonate (NaLAS), sodium paraffin sulphonate $NaPC_{12-16}S$ and mixtures thereof.

Additional Surfactant:

The hard surface cleaning composition may comprise up to 15% by weight of an additional surfactant, preferably selected from: an amphoteric, zwitterionic, and mixtures thereof. More preferably, the hard surface cleaning composition can comprise from 0.5% to 5%, or from 0.5% 15 to 3%, or from 0.5% to 2% by weight of the additional surfactant.

Suitable zwitterionic surfactants typically contain both cationic and anionic groups in substantially equivalent proportions so as to be electrically neutral at the pH of use, and are well known in the art. Some common examples of zwitterionic surfactants (such as betaine/sulphobetaine surfacants) are described in U.S. Pat. Nos. 2,082,275, 2,702, 279 and 2,255,082.

Amphoteric surfactants can be either cationic or anionic depending upon the pH of the composition. Suitable amphoteric surfactants include dodecylbeta-alanine, N-alkyltaurines such as the one prepared by reacting dodecylamine with sodium isethionate, as taught in U.S. Pat. No. 2,658, 072, N-higher alkylaspartic acids such as those taught in U.S. Pat. No. 2,438,091, and the products sold under the trade name "Miranol", as described in U.S. Pat. No. 2,528, 378. Other suitable additional surfactants can be found in McCutcheon's Detergents and Emulsifers, North American Ed. 1980.

Optional Ingredients:

Chelating Agent:

The liquid hard surface cleaning composition can comprise a chelating agent or crystal growth inhibitor. Suitable chelating agents, in combination with the surfactant system, improve the shine benefit. Chelating agent can be incorporated into the compositions in amounts ranging from 0.05% to 5.0% by weight of the total composition, preferably from 0.1% to 3.0%, more preferably from 0.2% to 2.0% and most preferably from 0.2% to 0.4%.

Suitable phosphonate chelating agents include ethylene diamine tetra methylene phosphonates, and diethylene triamine penta methylene phosphonates (DTPMP), and can be present either in their acid form or as salts.

A preferred biodegradable chelating agent for use herein is ethylene diamine N,N'-disuccinic acid, or alkali metal, or alkaline earth, ammonium or substitutes ammonium salts thereof or mixtures thereof, for instance, as described in U.S. Pat. No. 4,704,233. A more preferred biodegradable chelating agent is L-glutamic acid N,N-diacetic acid (GLDA) commercially available under tradename Dissolvine 47S from Akzo Nobel.

Suitable amino carboxylates include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanoldiglycines, and methyl glycine diacetic acid (MGDA), both in their acid form, or in their alkali metal, ammonium, and substituted ammonium salt forms. Particularly suitable amino carboxylate to be used herein is propylene diamine tetracetic acid (PDTA) which is, for instance, commercially available from BASF under the trade name Trilon FS® and methyl glycine di-acetic acid (MGDA). Most preferred aminocarboxylate used herein is diethylene triamine pentaacetate (DTPA) from BASF. Further carboxylate chelating agents for use herein include salicylic acid, aspartic acid, glutamic acid, glycine, malonic acid or mixtures thereof.

Additional Polymers:

The liquid hard surface cleaning composition may comprise an additional polymer. It has been found that the presence of a specific polymer as described herein, when present, allows further improving the grease removal performance of the liquid composition due to the specific sudsing/foaming characteristics they provide to the composition. Suitable polymers for use herein are disclosed in co-pending EP patent application EP2272942 (09164872.5) and granted European patent EP2025743 (07113156.9).

The polymer can be selected from the group consisting of: a vinylpyrrolidone homopolymer (PVP); a polyethyleneglycol dimethylether (DM-PEG); a vinylpyrrolidone/dialkylaminoalkyl acrylate or methacrylate copolymers; a polystyrenesulphonate polymer (PSS); a poly vinyl pyridine-N-oxide (PVNO); a polyvinylpyrrolidone/vinylimidazole copolymer (PVP-VI); a polyvinylpyrrolidone/polyacrylic acid copolymer (PVP-AA); a polyvinylpyrrolidone/vinylacetate copolymer (PVP-VA); a polyacrylic polymer or polyacrylicmaleic copolymer; and a polyacrylic or polyacrylic maleic phosphono end group copolymer; and mixtures thereof.

Typically, the liquid hard surface cleaning composition may comprise from 0.005% to 5.0% by weight of the total composition of said polymer, preferably from 0.10% to 4.0%, more preferably from 0.1% to 3.0% and most preferably from 0.20% to 1.0%.

Fatty acids are less preferred since they can affect the performance of many antimicrobial agents. If present, the fatty acid is preferably present at low levels of less than 0.5 wt % and can include the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms. Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, whale and fish oils and/or babassu oil. For example coconut fatty acid is commercially available from KLK OLEA under the name PALMERAB1211.

Typically, the liquid hard surface cleaning composition may comprise up to 6.0% by weight of the total composition of said fatty acid, preferably from 0.1% to 3.0%, more preferably from 0.1% to 2.0% and most preferably from 0.15% to 1.5% by weight of the total composition of said fatty acid.

Typically, the liquid hard surface cleaning composition may comprise up to 2.0% by weight of the total composition of said branched fatty alcohol, preferably from 0.10% to 1.0%, more preferably from 0.1% to 0.8% and most preferably from 0.1% to 0.5%.

Solvent:

The liquid compositions of the present invention may comprise a solvent or mixtures thereof as a preferred optional ingredient.

Suitable solvent is selected from the group consisting of: ethers and diethers having from 4 to 14 carbon atoms; glycols or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof. Ethers such as n-butoxypropanol and glycol ethers such as dipropylene glycol n-butyl ether are particularly preferred.

When present, the solvent can be present at a level of from 0.1 wt % to 10 wt %, or 0.2 wt % to 5 wt %, or 0.5 wt % to 3 wt %.

Other Optional Ingredients:

The liquid hard surface cleaning compositions may comprise a variety of other optional ingredients depending on the technical benefit aimed for and the surface treated. Suitable optional ingredients for use herein include perfume, builders, other polymers, buffers, bactericides, hydrotropes, colorants, stabilisers, radical scavengers, abrasives, soil suspenders, brighteners, anti-dusting agents, dispersants, dye transfer inhibitors, pigments, silicones and/or dyes.

Method of Cleaning a Surface:

The liquid hard surface cleaning compositions described herein are particularly suited for cleaning surfaces selected from the group consisting of: glazed or non-glazed ceramic tiles, enamel, stainless steel, Inox®, Formica®, vinyl, no-wax vinyl, linoleum, melamine, glass, plastics and plastified wood, and combinations thereof. In particular, the compositions are particularly suited for reducing or removing antimicrobial activity from the surface, and for cleaning when an amine oxide surfactant, other nonionic surfactant, and mixtures thereof is present.

For general cleaning, especially of floors, the preferred method of cleaning comprises the steps of:

a) diluting a liquid hard surface cleaning described herein, to a dilution level of from 0.1% to 2% by volume, and b) applying the diluted composition to a hard surface.

In preferred embodiments, the liquid hard surface cleaning composition may be diluted to a level of from 0.3% to 1.5% by volume. The liquid hard surface cleaning composition may be diluted to a level of from 0.4% to 0.6% by volume, especially where the liquid hard surface cleaning composition has a total surfactant level of greater than or equal to 5% by weight. Where the liquid hard surface cleaning composition has a total surfactant level of less than 5% by weight, the liquid hard surface cleaning composition may be diluted to a level of from 0.7% to 1.4% by volume. In preferred embodiments, the liquid hard surface cleaning composition is diluted with water.

The dilution level is expressed as a percent defined as the fraction of the liquid hard surface cleaning composition, by volume, with respect to the total amount of the diluted composition. For example, a dilution level of 5% by volume is equivalent to 50 ml of the liquid hard surface cleaning composition being diluted to form 1000 ml of diluted composition.

The diluted composition can be applied by any suitable means, including using a mop, sponge, or other suitable implement.

The hard surface may be rinsed, preferably with clean water, in an optional further step, and also as a further step, wiped, such as with a cloth.

Alternatively, and especially for particularly dirty or greasy spots, or spots which have been contacted by microbes, the liquid hard surface cleaning compositions, can be applied neat to the hard surface. When amine oxide and a further non-ionic surfactant is present, the composition provides improves penetration and removal of the stain, and especially of greasy stains, leading to improved surfactancy action and stain removal, as well as improved hygiene.

By "neat", it is to be understood that the liquid composition is applied directly onto the surface to be treated without undergoing any significant dilution, i.e., the liquid composition herein is applied onto the hard surface as described herein, either directly or via an implement such as a sponge, without first diluting the composition. By significant dilution, what is meant is that the composition is diluted by less than 10 wt %, preferably less than 5 wt %, more preferably less than 3 wt %. Such dilutions can arise from the use of damp implements to apply the composition to the hard surface, such as sponges which have been "squeezed" dry.

In another preferred embodiment of the present invention said method of cleaning a hard surface includes the steps of applying, preferably spraying, said liquid composition onto said hard surface, leaving said liquid composition to act onto said surface for a period of time to allow said composition to act, with or without applying mechanical action, and optionally removing said liquid composition, preferably removing said liquid composition by rinsing said hard surface with water and/or wiping said hard surface with an appropriate instrument, e.g., a sponge, a paper or cloth towel and the like.

The compositions of the present invention can also be used for improving surface shine, since the beading of the composition results in less residue formation on the treated surface, and also greater removal of residues when the surface is wiped.

Methods:

A) pH Measurement:

The pH is measured on the neat composition, at 25° C., using a Sartarius PT-10P pH meter with gel-filled probe (such as the Toledo probe, part number 52 000 100), calibrated according to the instructions manual.

B) % Haze

The % Haze is preferably measured prior to the addition of dye and light scattering agents such as opacifying agents and silicone emulsions. The samples are prepared to be essentially free of bubbles, either by ensuring limited or no bubble entrainment during making, or by using suitable methods known in the Art, for removing the bubbles. Suitable means include leaving the samples to degass over a suitable period of time, vacuum degassing, centrifugation, and/or ultrasound treatments.

The % Haze is measured using a Hunterlab Colorquest XE-Touch and the easymathQC version 3.84.00 software. The Hunterlab Colorquest XE-Touch is set up with CIE C/2° illumination, and a CIE d/8° geometry which conforms to the requirements of ASTM D1003 Section 8: Procedure B Spectrophotometer for measuring % Haze. The % Haze is calculated by the software by measuring the ratio of the diffuse light relative to the total light transmitted. The procedure provided by Hunterlab was used, using a Quartz SUPRASIL 101-QS cuvette having 1 cm path-length for containing the sample to be measured. For the reference measurements, a 1 cm path-length Quartz SUPRASIL 101-QS cuvette filled with distilled water was used. The % Haze is measured at 25° C.

C) Nuclear Magnetic Resonance (NMR) Spectrophotometry:

To determine the type of monomers used for copolymerization, and composition of hydrophobically alkali-soluble emulsions (HASE) polyacrylates 2D proton-carbon NMR is used. The 2D experiment is a Hetero-nuclear Single Quantum Coherence (HSQC) experiment where the measurement is carried out in the 1H detected mode via single quantum coherence with proton decoupling in the 13C domain, by using data sets of 2049×256 points. This technique is particularly used for HASE polyacrylate analysis to differentiate overlapping signals in 1H spectra which are due to similar protons bound to different carbons, for example in 1H spectra of HASE polyacrylates the signal for ethyl ester and butyl ester proton falls at δ (ppm) ~4.05 but in 13C spectra distinct peaks are observed corresponding to ethyl and butyl ester.

The HASE polyacrylate samples are prepared in DMSO-d6 (Cambridge Isotopes, Andover, Mass.) solvent with concentration 5 mg/ml. The NMR spectra is acquired at Bruker NMR spectrophotometer operating at 600 MHz equipped with cryo probe.

The area under the signal is proportional to the number of protons that signal corresponds to.

The molar composition is determined by comparing the integral intensities of corresponding groups in the 1D and/or 2D NMR spectrum. It is important to realize that the compositional information represents a global average and provides no details regarding the compositional heterogeneity within the population of polymer chains.

On the one hand, each alkyl (meth)acrylate monomer molar percentage is determined by integrating the area for the hydrogens corresponding to the different monomers respectively:

$$\% \text{ mol } R_i = \frac{\frac{A_{H_i}}{n^\circ H_i} \times 100}{\sum \frac{A_{H_i}}{n^\circ H_i}}$$

being $R_i$ each of the different alkyl (meth)acrylate monomers and Hi the corresponding Hydrogens associated to them.

In the case of monomers comprising a carboxylic acid group (—COOH), molar percentage is determined by the difference between the —$CH_2$— groups from the main carbon chain and the other monomers.

$$\% \text{ mol COOH} = \left( \frac{A_{CH_2}}{2} - \frac{\frac{A_{H_i}}{n^\circ H_i}}{\sum \frac{A_{H_i}}{n^\circ H_i}} \right) \times 100$$

A) pH Measurement:

The pH is measured on the neat composition, at 25° C., using a Sartorius PT-10P pH meter with gel-filled probe (such as the Toledo probe, part number 52 000 100), calibrated according to the instructions manual.

B) % Haze

The % Haze is preferably measured prior to the addition of dye and light scattering agents such as opacifying agents and silicone emulsions. The samples are prepared to be essentially free of bubbles, either by ensuring limited or no bubble entrainment during making, or by using suitable methods known in the Art, for removing the bubbles. Suitable means include leaving the samples to degass over a suitable period of time, vacuum degassing, centrifugation, and/or ultrasound treatments.

The % Haze is measured using a Hunterlab Colorquest XE-Touch and the easymathQC version 3.84.00 software. The Hunterlab Colorquest XE-Touch is set up with CIE C/2° illumination, and a CIE d/8° geometry which conforms to the requirements of ASTM D1003 Section 8: Procedure B Spectrophotometer for measuring % Haze. The % Haze is calculated by the software by measuring the ratio of the diffuse light relative to the total light transmitted. The procedure provided by Hunterlab was used, using a Quartz SUPRASIL 101-QS cuvette having 1 cm path-length for containing the sample to be measured. For the reference measurements, a 1 cm path-length Quartz SUPRASIL 101-QS cuvette filled with distilled water was used. The % Haze is measured at 25° C.

EXAMPLES

The following compositions were prepared by simple mixing. Compositions A, B, C, and E were of the invention, comprising hydrophobic alkali swellable emulsions (HASE) comprising a thickening polymer, the thickening polymer comprising C4-C8 alkyl (meth)acrylate monomer at a level of less than 45 mol % of the thickening polymer, and less than 3 mol % of associative monomer. Comparative composition D comprised Novothix HC200, a hydrophobic alkali swellable emulsions (HASE) comprising a thickening polymer, the thickening polymer comprising greater than 45 mol % of C4-C8 alkyl (meth)acrylate monomer. Comparative composition F comprised Synthalen W800 which comprises a thickening polymer having no associative monomer (ASE polymeric thickener).

As can be seen from the data below, antimicrobial compositions A to E provide the desired viscosity improvement, while being less hazy.

| | A % | B % | C % | D* % | E % | F* % |
|---|---|---|---|---|---|---|
| Monoethanolamine | 0.900 | 0.900 | 0.900 | 0.900 | 0.900 | 0.900 |
| Nonionic C9/11 EO8[1] | 6.000 | 6.000 | 6.000 | 6.000 | 6.000 | 6.000 |
| Amine Oxide C12/14[2] | 2.250 | 2.250 | 2.250 | 2.250 | 2.250 | 2.250 |
| $Na_2CO_3$ | 0.400 | 0.400 | 0.400 | 0.400 | 0.400 | 0.400 |
| Citric Acid | 0.300 | 0.300 | 0.300 | 0.300 | 0.300 | 0.300 |
| diethylene triamine penta methyle phosphonic acid sodium salt | 0.600 | 0.600 | 0.600 | 0.600 | 0.600 | 0.600 |
| Perfume | 0.950 | 0.950 | 0.950 | 0.950 | 0.950 | 0.950 |
| Polydimethylsiloxane | 0.006 | 0.006 | 0.006 | 0.006 | 0.006 | 0.006 |
| Didecyl dimethyl ammonium chloride[3] | 1.200 | 1.200 | 1.200 | 1.200 | 1.200 | 1.200 |
| NaOH | to pH 11.1 | to pH 11.1 | to pH 11.1 | to pH 11.1 | to pH 11.1 | to pH 11.1 |
| Minors and water | up to 100% | up to 100% | up to 100% | up to 100% | up to 100% | up to 100% |
| Rheosolve 650[4] | 1.25 | — | — | — | — | — |
| Polymer A[5] | — | 1.25 | — | — | — | — |
| Rheosolve 637[6] | — | — | 1.25 | — | — | — |
| Novethix HC200[7] | — | — | — | 1.25 | — | |
| Rheovis AT120[8] | — | — | — | — | 1.25 | |
| Synthalen W800[9] | — | — | — | — | — | 1.25 |
| viscosity at 10/s (Pa · s) | 0.612 | 0.228 | 0.618 | 1.172 | 0.614 | 0.249 |
| % Haze | 5.9 | 3 | 0.4 | 6.2 | 16.6 | 93 |

*Comparative

[1]Neodol 91-8, supplied by Shell

[2]Supplied by Huntsman

[3]Bardac 2270ETM, supplied by Lonza

[4]Rheosolve ® 650, a HASE rheology modifying agent supplied by Coatex.

[5]Polymer A, a HASE rheology modifiying agent comprising 54 mol % ethyl acrylate monomer and 46% methacrylic acid monomer.

[6]Rheosolve ® 637, a HASE rheology modifiying agent supplied by Coatex.

[7]Novethix ® HC200, a HASE rheology modifiying agent supplied by Lubrizol.

[8]Rheovis ® AT120, a HASE rheology modifiying agent supplied by BASF.

[9]Synthalen ® W800, an ASE rheology modifiying agent supplied by 3V Sigma.

The following compositions were prepared by simple mixing. Compositions G to J were of the invention, comprising hydrophobic alkali swellable emulsions (HASE) comprising a thickening polymer, the thickening polymer comprising C4-C8 alkyl (meth)acrylate monomer at a level of less than 45 mol % of the thickening polymer, and less than 3 mol % of associative monomer. Compositions K and L, comprising Novethix HC200 and Synthalen W800 are comparative and fall outside of present claim 1.

As can be seen from the data below, all of the compositions of the invention meet the target antimicrobial efficacy of at least a log 4.5 reduction of *staphylococcus aureus*, using the method of EN1276 (Chemical Disinfectants Bactericidal Activity Testing), in less than 3 minutes, while comparative composition K, comprising Novethix HC200, having a butyl acrylate level of greater than 45 mol %, does not meet the antimicrobial efficacy level. Comparative composition L, comprising Synthalen W800, an ASE thickener, meets the target antimicrobial efficacy level but has a haziness well in excess of that provided by the inventive compositions.

| | G % | H % | I % | J % | K* % | L* % |
|---|---|---|---|---|---|---|
| Monoethanolamine | 0.9 | 0.9 | 0.9 | 0.9 | 0.9 | 0.9 |
| Nonionic C9/11 EO8 | 6.8 | 6.8 | 6.8 | 6.8 | 6.8 | 6.8 |
| Amine Oxide C12/14 | 2.3 | 2.3 | 2.3 | 2.3 | 2.3 | 2.3 |
| $Na_2CO^3$ | 0.4 | 0.4 | 0.4 | 0.4 | 0.4 | 0.4 |
| Didecyl dimethyl ammonium chloride | 1.0 | 1.0 | 1.0 | 1.0 | 1.0 | 1.0 |
| Minors and water | up to 100% | up to 100% | up to 100% | up to 100% | up to 100% | up to 100% |
| NaOH | to pH 11.1 | to pH 11.1 | to pH 11.1 | to pH 11.1 | to pH 11.1 | to pH 11.1 |
| Rheosolve 650[1] | 1.0 | — | — | — | — | — |
| Rheosolve 637[3] | — | 1.0 | — | — | — | — |
| Capigel 98[4] | — | — | 1.0 | — | — | — |
| Rheovis AT120[6] | — | — | — | 1.0 | — | — |
| Novethix HC200[5] | — | — | — | — | 1.0 | — |
| Synthalen W800[10] | — | — | — | — | — | 1.0 |
| log reduction of *staphylococcus aureus*, using the method of EN1276 (Chemical Disinfectants Bactericidal Activity Testing), in less than 3 minutes | >5.5 | >5.5 | 4.7 | 5.0 | <4.4 | >5.1 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hard surface cleaning composition comprising:

a) a cationic antimicrobial agent selected from quaternary ammonium compounds selected from the group consisting of: didecyl dimethyl ammonium chloride, a blend of alkyl dimethyl benzyl ammonium chloride and alkyl dimethyl ethylbenzyl ammonium chloride, and mixtures thereof;

b) a hydrophobic alkali swellable emulsions (HASE) comprising a thickening polymer, the thickening polymer comprising:

(i) a butyl acrylate monomer at a level greater than 44 mol %;

(ii) greater than 0 and less than about 65 mol % of alkyl (meth)acrylate monomer, wherein the level of C4-C8 alkyl (meth)acrylate monomer is less than about 35 mol % of the thickening polymer, wherein the C1-C3 alkyl (met)acrylate monomer is present at a level of greater than about 35 mol % of the thickening polymer;

(iii) from about 0.1 to about 3 mol % of an associative monomer according to formula (I) or formula (II):

$$R_1—CH=CH—COO—(CH_2CH_2O)_n—R_2 \quad \text{formula (I)}$$

$$R_1—CH=CH—R_3—NH—COO—(CH_2CH_2O)_n—R_2 \quad \text{formula (II)}$$

in which:

i. $R_1$ is H, C or COOH ii. $R_2$ is a C8-C30 alkyl chain, preferably aliphatic, preferably saturated, preferably linear;

iii. n is an integer between about 2 and about 150; and iv. $R_3$ is a C1-12 alkyl chain;

wherein the composition is free of anionic surfactant and wherein the composition has a pH of greater than about 10.0 and less than about 12.

2. The hard surface cleaning composition according to claim 1, wherein the liquid hard surface cleaning composition comprises from about 0.1% to about 10.0% by weight of the total composition of said thickener.

3. The hard surface cleaning composition according to claim 2, wherein the liquid hard surface cleaning composition comprises from about 0.2% to about 2.0% by weight of the total composition of said thickener.

4. The hard surface cleaning composition according to claim 1, wherein the carboxylic acid containing monomer is selected from the group consisting of: acrylic acid, methacrylic acid, itaconic acid or maleic acid, and mixtures thereof.

5. The hard surface cleaning composition according to claim 1, wherein the monomers (i), (ii), and (iii) are randomly distributed in the thickening polymer.

6. The hard surface cleaning composition according to claim 1, wherein the composition further comprises a surfactant.

7. The hard surface cleaning composition according to claim 6, wherein the composition further comprises a nonionic surfactant.

8. A method of cleaning hard surfaces, the method comprising the steps of:

a) diluting a liquid hard surface cleaning composition according to claim 1, and b) applying the diluted composition to a hard surface.

* * * * *